US011151929B2

(12) United States Patent
He

(10) Patent No.: US 11,151,929 B2
(45) Date of Patent: Oct. 19, 2021

(54) CONTROL METHOD AND CONTROL CIRCUIT FOR DISPLAY DEVICE

(71) Applicant: HKC Corporation Limited, Shenzhen (CN)

(72) Inventor: Huailiang He, Shenzhen (CN)

(73) Assignee: HKC CORPORATION LIMITED, Shenzhen (CN)

( * ) Notice: Subject to any disclaimer, the term of this patent is extended or adjusted under 35 U.S.C. 154(b) by 0 days.

(21) Appl. No.: 16/641,474

(22) PCT Filed: Aug. 15, 2018

(86) PCT No.: PCT/CN2018/100589
§ 371 (c)(1),
(2) Date: Feb. 24, 2020

(87) PCT Pub. No.: WO2019/042125
PCT Pub. Date: Mar. 7, 2019

(65) Prior Publication Data

US 2021/0158745 A1 May 27, 2021

(30) Foreign Application Priority Data

Aug. 29, 2017 (CN) ..... 201710754678.2

(51) Int. Cl.
*G09G 3/20* (2006.01)

(52) U.S. Cl.
CPC ..... *G09G 3/2096* (2013.01); *G09G 3/2007* (2013.01); *G09G 2320/0233* (2013.01);
(Continued)

(58) Field of Classification Search
None
See application file for complete search history.

(56) References Cited

U.S. PATENT DOCUMENTS 5,313,287 A * 5/1994 Barton ..... H04N 1/4055 382/252
5,727,192 A * 3/1998 Baldwin ..... G06F 3/14 345/506

(Continued)

FOREIGN PATENT DOCUMENTS

CN 107068110 8/2017

*Primary Examiner* — Chad M Dicke
(74) *Attorney, Agent, or Firm* — WPAT, PC

(57) ABSTRACT

Embodiments of the disclosure disclose a control method and a control circuit for a display device. The control method for a display device includes reading basic configuration parameters from a memory in a first time period by a register control module; receiving display data from a system-level chip by a data receiving module; performing an image basic processing on the received display data by a basic processing module; sending the data subjected to image basic processing to a drive circuit of the display device by a data sending module; reading image optimization configuration parameters from the memory in a second time period by the register control module; performing an image optimization processing on received display data of a subsequent boot animation by an optimization processing module; and sending the data subjected to image optimization processing to the drive circuit of the display device by the data sending module.

13 Claims, 5 Drawing Sheets

(52) U.S. Cl.
CPC ..... *G09G 2320/0242* (2013.01); *G09G 2320/0673* (2013.01); *G09G 2330/026* (2013.01)

(56) References Cited

U.S. PATENT DOCUMENTS

| | | | | |
|---|---|---|---|---|
| 2008/0186325 | A1* | 8/2008 | Higgins | G06T 11/001 345/592 |
| 2012/0236013 | A1* | 9/2012 | Wyatt | G06F 1/325 345/522 |
| 2017/0169746 | A1* | 6/2017 | Wu | G09G 5/395 |

* cited by examiner

CONTROL METHOD AND CONTROL CIRCUIT FOR DISPLAY DEVICE

FIELD OF THE DISCLOSURE

The disclosure relates to the field of display technology, and more particularly to a control method and a control circuit for a display device.

BACKGROUND

With the improvement of user's requirements on picture display quality of a display device, there are more and more functions for improving the picture display quality, such as a digital gamma function, an over drive function, a demura function, a color enhancement function, etc.

During boot, an image processing chip (TCON) needs to read configuration parameters required for initializing all above functions from a memory, and then picture display of boot is carried out. With the increase of functions for improving the picture display quality, the longer the time occupied by reading the configuration parameters required for initializing all above functions is, the longer the time waiting for the picture display is, which leads to slow boot.

SUMMARY

Embodiments of the disclosure provide a control method and a control circuit for a display device, to improve a boot display speed of a display device.

The embodiment of the disclosure provides a control method for a display device, including reading first configuration parameters from a memory module in a first time period by a register control module when a system powering-on status is monitored; receiving display data from a system-level chip by a data receiving module according to the first configuration parameters; performing an image basic processing on the received display data by a basic processing module; sending data subjected to the image basic processing to a drive circuit of the display device by a data sending module; reading image optimization configuration parameters from the memory module in a second time period by the register control module; performing an image optimization processing on received display data of a subsequent boot animation by an optimization processing module according to the image optimization configuration parameters; and sending data subjected to the image optimization processing to the drive circuit of the display device by the data sending module, so as to display the boot animation after the image optimization processing.

In one embodiment, the image optimization configuration parameters include at least one selected from the group consisting of: digital gamma configuration parameters, over drive configuration parameters, demura configuration parameters, color enhancement configuration parameters and dithering processing configuration parameters.

In one embodiment, the image optimization processing includes at least one selected from the group consisting of: a digital gamma processing, an over drive processing, a demura processing, a color enhancement processing and a dithering processing.

In one embodiment, the image optimization processing includes at least one selected from the group consisting of: a digital gamma processing, an over drive processing, a demura processing, a color enhancement processing and a dithering processing.

In one embodiment, the first configuration parameters include configuration parameters required for data receiving, data sending and data swapping.

In one embodiment, the image basic processing includes a data swapping processing.

In one embodiment, the image basic processing includes swapping orders of display data, to adapt to an arrangement of pixels of the display panel and a display order of the pixels.

In one embodiment, receiving display data from a system-level chip by a data receiving module according to the first configuration parameters includes: when the data receiving module monitors a completion signal of reading the first configuration parameters from the register control module, receiving the display data from the system-level chip by the data receiving module according to the first configuration parameters.

In one embodiment, performing an image optimization processing on received display data of a subsequent boot animation by an optimization processing module according to the image optimization configuration parameters includes: when the optimization processing module monitors a completion signal of reading the image optimization configuration parameters sent from the register control module, performing the image optimization processing on the received display data of the subsequent boot animation by the optimization processing module according to the image optimization configuration parameters.

In one embodiment, the register control module and the memory module are connected through a serial peripheral interface bus or an inter-integrated circuit bus.

The embodiment of the disclosure also provides a control circuit for a display device, including a register control module, configured for reading first configuration parameters from a memory module in a first time period when a system powering-on status on is monitored, and reading image optimization configuration parameters from the memory module in a second time period; a data receiving module, connected to a system-level chip and configured for receiving display data from the system-level chip according to the first configuration parameters; a basic processing module, configured for performing an image basic processing on the received display data according to the first configuration parameters; a data sending module, connected to a drive circuit of the display device and configured for sending data subjected to the image basic processing to the drive circuit of the display device according to the first configuration parameters; and an optimization processing module, configured for performing an image optimization processing on received display data of a subsequent boot animation according to the image optimization configuration parameters; wherein the data sending module is further configured for sending data subjected to the image optimization processing and the image basic processing to the drive circuit of the display device, so as to display the boot animation after the image optimization processing.

In one embodiment, the optimization configuration module includes at least one selected from the group consisting of: a digital gamma processing submodule, an over drive processing submodule, a demura processing submodule, a color enhancement processing submodule and a dithering processing submodule.

In one embodiment, the image optimization configuration parameters include at least one selected from the group consisting of: digital gamma configuration parameters, over drive configuration parameters, demura configuration parameters, color enhancement configuration parameters and dithering processing configuration parameters.

In one embodiment, the first configuration parameters include configuration parameters required for data receiving, data sending and data swapping.

In one embodiment, the basic processing module includes: a data swapping module, configured for swapping the received display data or data subjected to the image optimization processing.

In one embodiment, the basic processing module includes: a data swapping module, configured for swapping orders of display data, to adapt to an arrangement of pixels of the display panel and a display order of the pixels.

In one embodiment, the register control module and the memory module are connected through a serial peripheral interface bus or an inter-integrated circuit bus.

In one embodiment, the memory module is a flash memory or an electrically erasable programmable read-only memory.

The embodiment of the disclosure also provides a control circuit for a display device, including a register control module, configured for reading first configuration parameters from a memory module in a first time period when a system powering-on status on is monitored, and reading image optimization configuration parameters from the memory module in a second time period; a data receiving module, connected to a system-level chip and configured for receiving display data from the system-level chip according to the first configuration parameters; a basic processing module, configured for performing an image basic processing on the received display data of a boot animation according to the first configuration parameters; a data sending module, connected to a drive circuit of the display device and configured for sending data subjected to the image basic processing to the drive circuit of the display device according to the first configuration parameters; and an optimization processing module, configured for performing an image optimization processing on received display data of a subsequent boot animation according to the image optimization configuration parameters; wherein the data sending module is further configured for sending data subjected to the image optimization processing and the image basic processing to the drive circuit of the display device, so as to display the boot animation after the image optimization processing; wherein the optimization configuration module includes at least one selected from the group consisting of: a digital gamma processing submodule, an over drive processing submodule, a demura processing submodule, a color enhancement processing submodule and a dithering processing submodule; and wherein the image optimization configuration parameters include at least one selected from the group consisting of: digital gamma configuration parameters, over drive configuration parameters, demura configuration parameters, color enhancement configuration parameters and dithering processing configuration parameters.

In one embodiment, the memory module is a flash memory or an electrically erasable programmable read-only memory.

According to the embodiments of the disclosure, during boot, an image processing chip reads the first configuration parameters from the memory module at first, receives the display data of boot animation from the system-level chip according to the first configuration parameters, and sends to the drive circuit of the display device after performing the image basic processing, so as to display the boot animation, then the image optimization configuration parameters are read, according to the image optimization configuration parameters, the received display data of the subsequent boot animation are subjected to image optimization processing and then sent to the drive circuit of the display device, so as to display the boot animation subjected to image optimization, thereby improving the boot display speed of the display device.

DETAILED DESCRIPTION OF PREFERRED EMBODIMENTS

The disclosure is further explained in detail in combination with accompanying drawings and embodiments. It is understandable that the specific embodiments described here are merely intended for explaining rather than limiting the disclosure. In addition, it also should be noted that in order for convenient description, the accompanying drawings only show part of instead of all related structures of the disclosure.

Figure 1A:
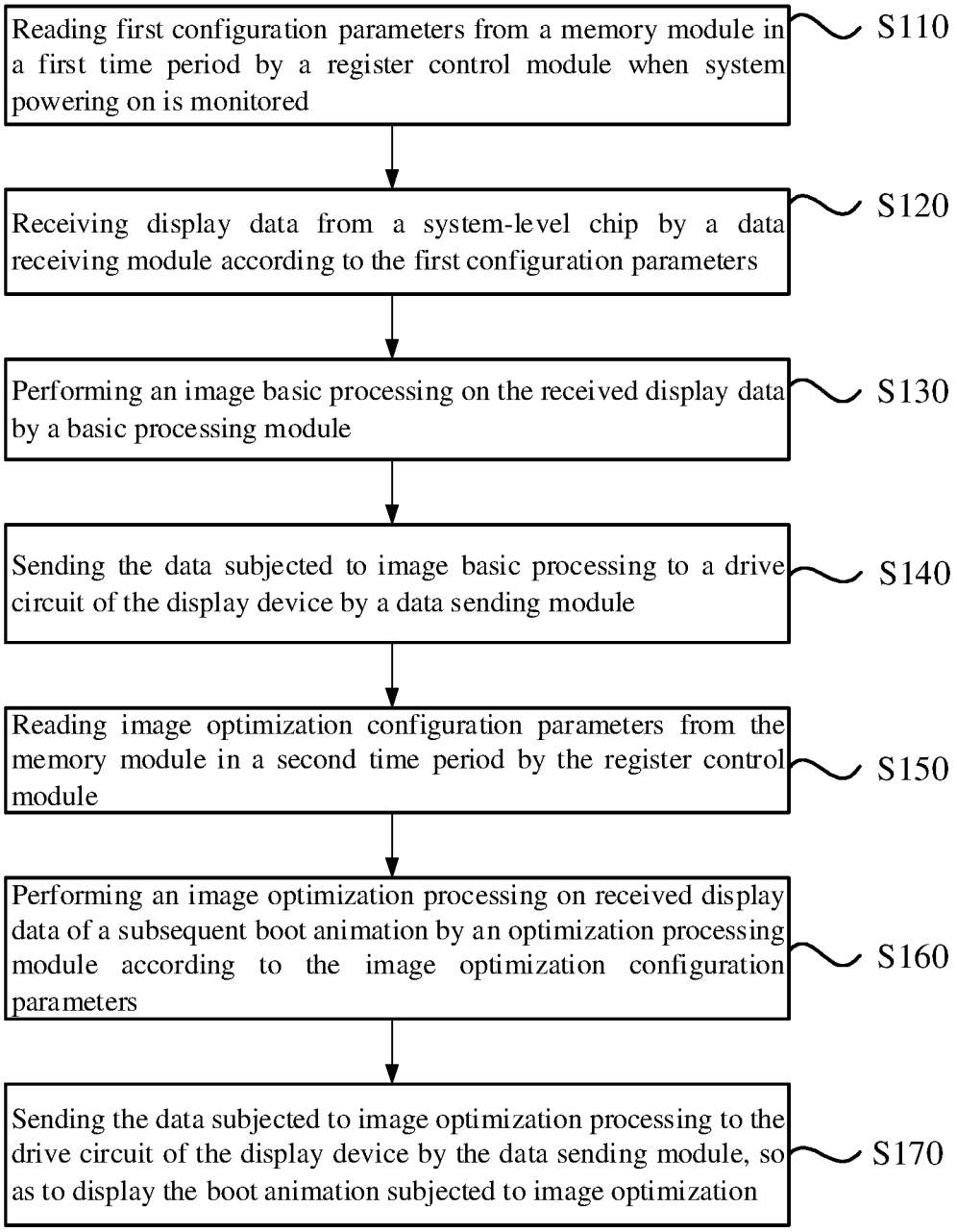
FIG. 1A is a flowchart of a control method for a display device provided in an embodiment of the disclosure.
Figure 1B:
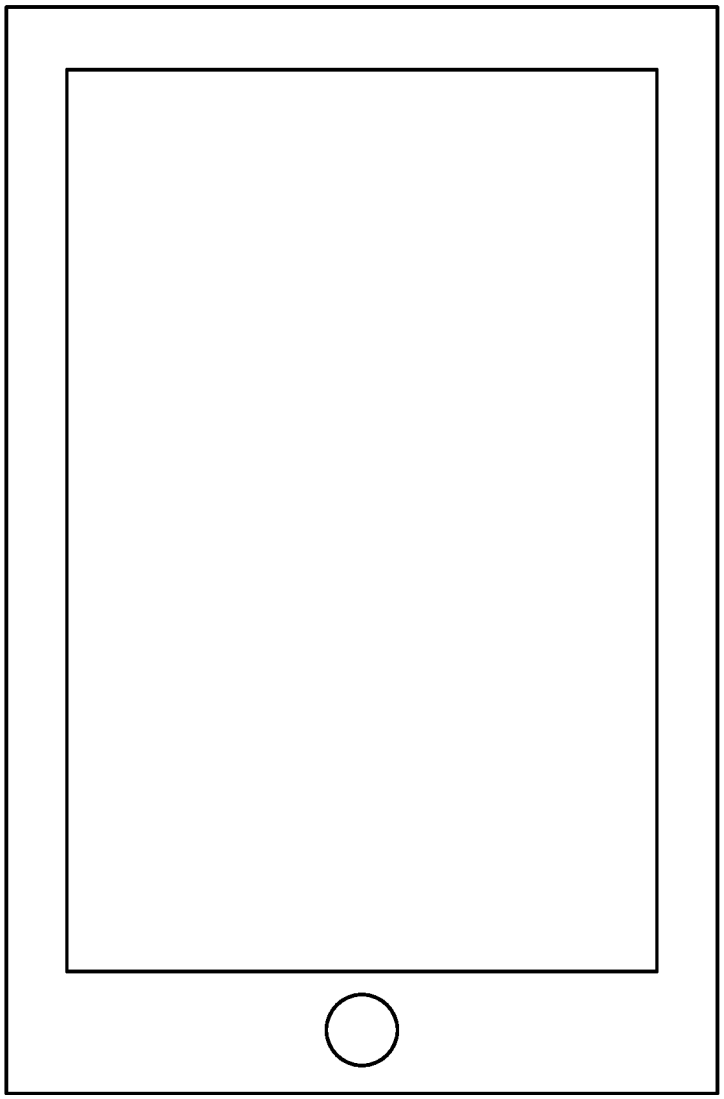
FIG. 1B is a structural schematic view of a display device provided in an embodiment of the disclosure.

FIG. 1A is a flowchart of a control method for a display device provided in the embodiment of the disclosure, the present embodiment is suitable for improving a boot speed of the display device, the method can be implemented by a control circuit for a display device provided by any embodiment of the disclosure, the control circuit for a display device may be integrated in a display device having a display function, the display device, for example, may be an electronic device such as a television device, a smart phone or a tablet computer, etc., as shown in FIG. 1B, which is a structural schematic view of a display device provided in the embodiment of the disclosure. As shown in FIG. 1A, the method specifically includes the following steps.

Step 110 first configuration parameters are read from a memory module in a first time period by a register control module when a system powering-on status on is monitored.

Wherein when the system powering on is monitored, the register control module of an image processing chip reads the first configuration parameters from the memory module. Optionally, the first configuration parameters include configuration parameters required for data receiving, data sending and data swapping. The configuration parameters required by data receiving include initialization configuration parameters required for the data receiving module of the image processing chip to communicate with the system-level chip, display data required to be received by the data receiving module of the image processing chip from the system-level chip, initialization configuration parameters required for decoding data formats, etc. The configuration parameters required for data sending include initialization configuration parameters required for the data sending module of the image processing chip to communicate with a drive circuit of the display device, etc. The configuration parameters for data swapping include initialization configuration parameters required for swapping the display data, etc. The duration of the first time period is the time occupied for the register control module of the image processing chip to read the first configuration parameters from the memory module.

Step 120 display data are received from a system-level chip by a data receiving module according to the first configuration parameters.

Wherein the display data may be boot animation. The display data of the boot animation are stored in the system-level chip.

Step 130 image basic processing is performed on the received display data by a basic processing module.

Wherein the image basic processing includes data swapping processing, that is, orders of the display data are swapped, to adapt to an arrangement rule of pixels of the display panel and a display order need of respective pixels.

Step 140 the data subjected to image basic processing are sent to a drive circuit of the display device by a data sending module.

Wherein the second time period is when the register control module of the image processing chip completely reads the first configuration parameters from the memory module, in the second time period, the data receiving module of the image processing chip receives the display data of the boot animation from the system-level chip according to the first configuration parameters, the basic processing module performs image basic processing on the received display data of the starting animation, and the data sending module sends the data subjected to image basic processing to the drive circuit of the display device, so as to display the boot animation. Since pictures of the boot animation are simple, the boot animation not subjected to the image optimization processing will not affect a picture quality feeling of the user, and the moment of boot display can be earlier.

Step 150 image optimization configuration parameters are read from the memory module by the register control module in the second time period.

Wherein the duration of the second time period is the time occupied for the register control module of the image processing chip to read the optimization configuration parameters from the memory module.

Step 160 image optimization processing is performed on the received display data of a subsequent boot animation by an optimization processing module according to the image optimization configuration parameters.

Wherein a third time period is when the register control module of the image processing chip completely reads the image optimization configuration parameters from the memory module, in the third time period, the display data of the subsequent boot animation received by the optimization processing module of the image processing chip and other pieces of display data of subsequent videos are subjected to the image optimization processing according to the image optimization configuration parameters and are then sent to the drive circuit of the display device after being subjected to image basic processing by the basic processing module, so as to display the boot animation subjected to image optimization and other videos. Optionally, the image optimization configuration parameters include at least one selected from the group consisting: digital gamma configuration parameters, over drive configuration parameters, demura configuration parameters, color enhancement configuration parameters and dithering processing configuration parameters. The image optimization processing includes at least one selected from the group consisting: a digital gamma processing, an over drive processing, a demura processing, a color enhancement processing and a dithering processing. The optimization processing module of the image processing chip may perform digital gamma processing on the received display data of the subsequent boot animation and the display data of other subsequent videos according to the digital gamma configuration parameters, such that three primary colors red, green and blue which are well adjusted proportionally are mixed into white. The over drive processing may be performed on the received display data of the subsequent boot animation and the display data of other subsequent videos according to the over drive configuration parameters. By increasing a voltage, a conversion speed, i.e., a twisting angle of liquid crystal molecules is accelerated, further the response time of liquid crystal is shortened and the problems of crosstalk and ghosting are improved. The demura processing may be performed on the received display data of the subsequent boot animation and the display data of other subsequent videos according to the demura configuration parameters, so as to eliminate the phenomenon of uneven brightness of respective pixels on the display panel. The color enhancement processing may be performed on the received display data of the subsequent boot animation and the display data of other subsequent videos according to the color enhancement configuration parameters to improve contrast and definition of the image. The image processing chip may perform dithering processing on the received display data of the subsequent boot animation and the display data of other subsequent videos according to the dithering processing configuration parameters, to make the picture display smooth. The reading sequence of the digital gamma configuration parameters, the over drive configuration parameters, the demura configuration parameters, the color enhancement configuration parameters and the dithering processing configuration parameters and the processing sequence of the digital gamma processing, the over drive processing, the demura processing, the color enhancement processing and the dithering processing may be designed according to a specific case of the display panel, for example, for some display panels with poor color display effect, the digital gamma configuration parameters may be read and the digital gamma processing may be performed at first, which are not limited by the embodiment of the disclosure.

Step 170 the data subjected to image optimization processing are sent to the drive circuit of the display device by the data sending module, so as to display the boot animation subjected to image optimization.

According to the technical solution of the present embodiment, during boot, the image processing chip reads the first configuration parameters from the memory module, receives the display data of the boot animation from the system-level chip according to the first configuration parameters, and sends to the drive circuit of the display device after performing the image basic processing, so as to display the boot animation, then the image optimization configuration parameters are read, according to the image optimization configuration parameters, the received display data of the subsequent boot animation are subjected to image optimization processing and then sent to the drive circuit of the display device, so as to display the boot animation subjected to image optimization, thereby improving the boot display speed of the display device.

Figure 2A:
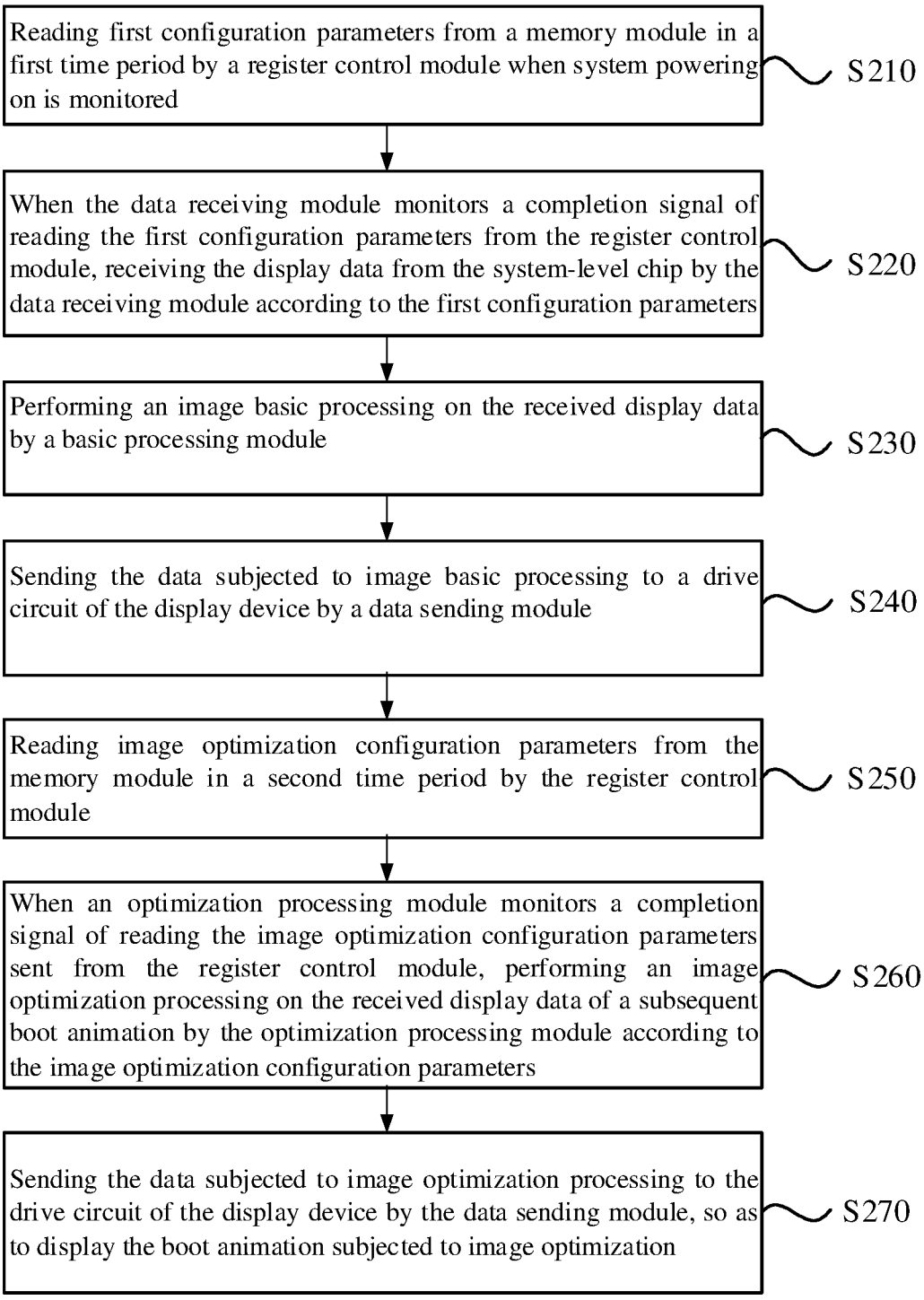
FIG. 2A is a flowchart of another control method for a display device provided in an embodiment of the disclosure.

FIG. 2A is a flowchart of another control method for a display device provided in the embodiment of the disclosure. The embodiment of the disclosure is optimized based on the above embodiment, specifically, receiving display data from a system-level chip by a data receiving module according to the first configuration parameters includes when the data receiving module monitors a completion signal of reading the first configuration parameters from the register control module, receiving the display data from the system-level chip by the data receiving module according to the first configuration parameters. Performing an image optimization processing on received display data of the subsequent boot animation by an optimization processing module according to the image optimization configuration parameters includes when the optimization processing module monitors a completion signal of reading the image optimization configuration parameters sent from the register control module, performing the image optimization processing on the received display data of the subsequent boot animation by the optimization processing module according to the image optimization configuration parameters.

Correspondingly, the method of the present embodiment includes the following steps.

Step 210 first configuration parameters are read from a memory module in a first time period by a register control module when a system powering-on status on is monitored.

Step 220 when the data receiving module monitors a completion signal of reading the first configuration parameters from the register control module, the display data are received from the system-level chip by the data receiving module according to the first configuration parameters.

Wherein when the register control module of the image processing chip completely reads the first configuration parameters from the memory module, the completion signal of reading the first configuration parameters will be generated to trigger the data receiving module, the basic processing module and the data sending module to start working.

Wherein the control method of the present embodiment is suitable for an LCD display device, an OLED display device, a QLED display device, a curve surface display device or other display devices.

Step 230 an image basic processing is performed on the received display data by the basic processing module.

Step 240 the data subjected to image basic processing are sent to a drive circuit of the display device by the data sending module.

Step 250 image optimization configuration parameters are read from the memory module in a second time period by the register control module.

Step 260 when the optimization processing module monitors a completion signal of reading the image optimization configuration parameters sent from the register control module, image optimization processing is performed on the received display data of a subsequent boot animation by the optimization processing module according to the image optimization configuration parameters.

Wherein when the register control module of the image processing chip completely reads the image optimization configuration parameters from the memory module, the completion signal of reading the image optimization configuration parameters will be generated to trigger the optimization processing module to start working.

Step 270 the data subjected to image optimization processing are sent to the drive circuit of the display device by the data sending module, so as to display the boot animation subjected to image optimization.

Figure 2B:
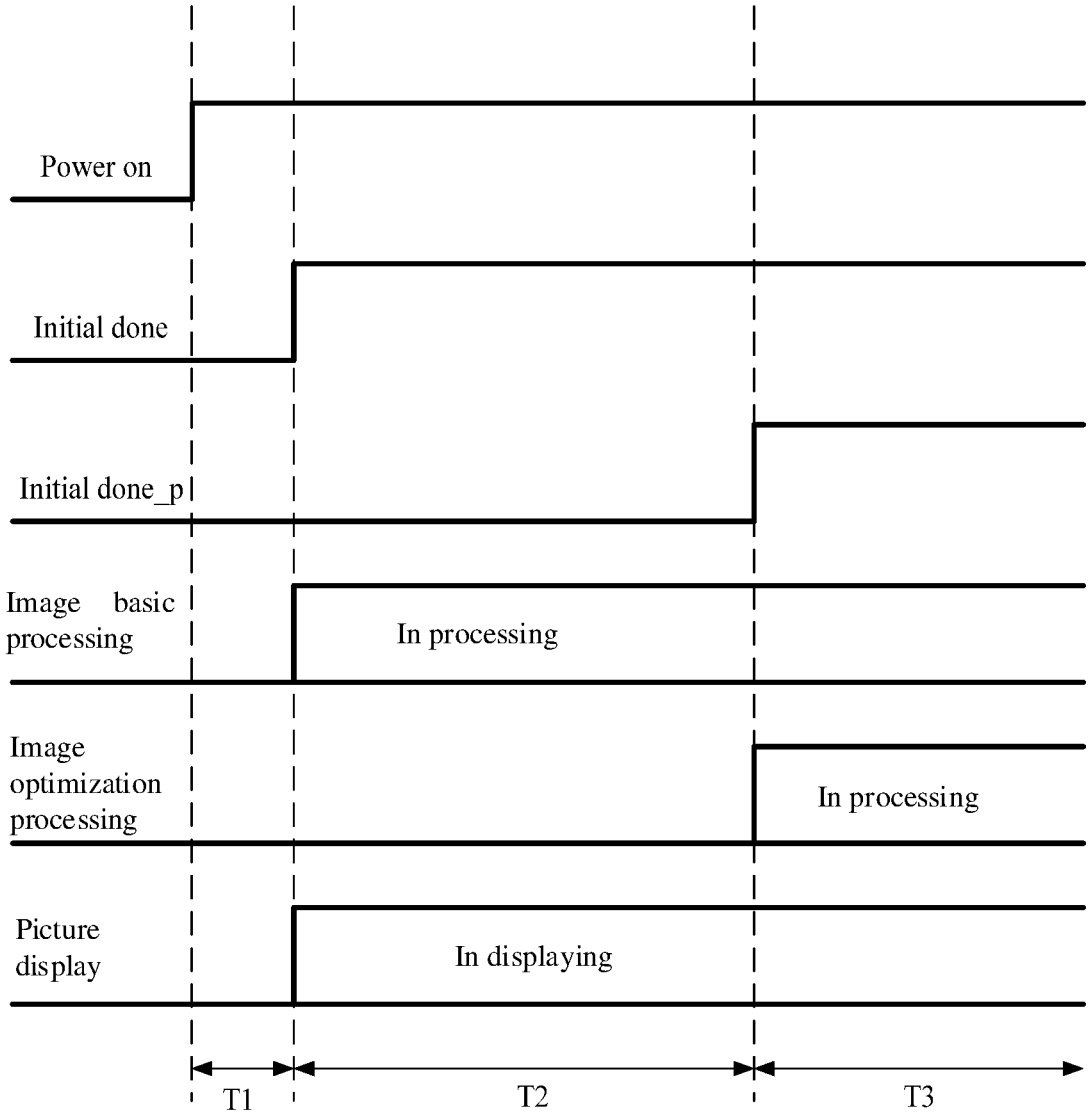
FIG. 2B is a timing sequence oscillogram about various signal output and various image processing procedures provided in an embodiment of the disclosure.

Exemplarily, FIG. 2B is a timing sequence oscillogram about various signal output and various image processing procedures provided in the embodiment of the disclosure, wherein as shown in FIG. 2B, Power on is powering on signal, Initial done is completion signal of reading the basic configuration parameters, Initial done_p is a completion signal of reading the image optimization configuration parameters, T1 is first time period, T2 is second time period, and T3 is third time period. Thus it can be known that the moment of boot display becomes the T1 moment from the original T1+T2 moment, thereby greatly improving the starting display speed.

Figure 3:
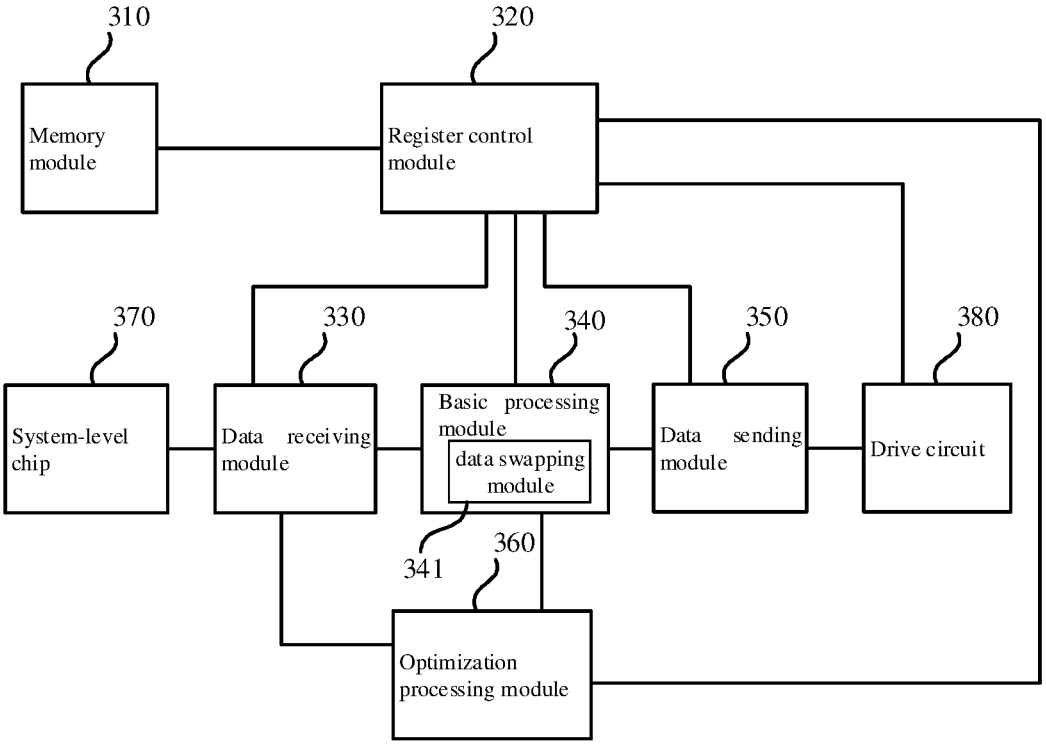
FIG. 3 is a structural schematic view of a control circuit for a display device provided in an embodiment of the disclosure.

FIG. 3 is a structural schematic diagram of a control device for a display device provided by the embodiment of the disclosure. The control method for a display device may be configured for executing the control method for a display device provided by any embodiment of the disclosure, as shown in FIG. 3, the control circuit for a display device includes a register control module 320, a data receiving module 330, a basic processing module, 340, a data sending module 350 and an optimization processing module 360.

Wherein the register control module 320 is configured for reading first configuration parameters from a memory module 310 in a first time period when a system powering-on status on is monitored, and reading image optimization configuration parameters from the memory module 310 in a second time period. The data receiving module 330 is connected to a system-level chip 370 and configured for receiving display data from the system-level chip 370 according to the first configuration parameters. The basic processing module 340 is configured for performing an image basic processing on the received display data according to the first configuration parameters. The data sending module 350 is connected to a drive circuit 380 of the display device, and configured for sending the data subjected to image basic processing to the drive circuit 380 of the display device according to the first configuration parameters. The optimization processing module 360 is configured for performing an image optimization processing on received display data of the subsequent boot animation according to the image optimization configuration parameters. The data sending module 350 is further configured for sending the data subjected to image optimization processing and image basic processing to the drive circuit 380 of the display device, so as to display the boot animation subjected to image optimization.

It should be noted that the memory module 310 is connected to the register control module 320 and configured for storing the first configuration parameters and the image optimization configuration parameters.

Wherein the register control module 320, the data receiving module 330, the basic processing module 340, the data sending module 350 and the optimization processing module 360 may be integrated in an image processing chip. The register control module 320 sends the first configuration parameters and the image optimization configuration parameters read from the memory module 310 to the corresponding modules for initialization of respective modules. Besides, when the memory module 310 completely reads the first configuration parameters, a completion signal of reading the first configuration parameters will be generated, and when the image optimization configuration parameters are completely read from the memory module, a completion signal of reading the image optimization configuration parameters will be generated.

Optionally, the optimization processing module 360 includes at least one selected from the group consisting: a digital gamma processing submodule, an over drive processing submodule, a demura processing submodule, a color enhancement processing submodule and a dithering processing submodule. The image optimization configuration parameters include at least one selected from the group consisting: digital gamma configuration parameters, over drive configuration parameters, demura configuration parameters, color enhancement configuration parameters and dithering processing configuration parameters.

Wherein the digital gamma processing submodule performs digital gamma processing on the display data according to the digital gamma configuration parameters. The over drive processing submodule performs over drive processing on the display data according to the over drive configuration parameters. The demura processing submodule performs demura processing on the display data according to the demura configuration parameters. The color enhancement processing submodule performs color enhancement processing on the display data according to the color enhancement configuration parameters. The dithering processing submodule performs dithering processing on the display data according to the dithering processing configuration parameters.

Optionally, the first configuration parameters include configuration parameters required for data receiving, data sending and data swapping. The basic processing module 340 includes a data swapping module 341, configured for swapping the received display data or the data subjected to image optimization processing.

Optionally, the memory module is a flash memory (FLASH) or an electrically erasable programmable read-only memory (EEPROM).

Optionally, the register control module and the memory module are connected through a serial peripheral interface (SPI) bus or inter-integrated circuit (I2C) bus.

It should be explained that the control circuit for a display device provided by the embodiment of the disclosure is configured for executing the control method for a display device provided by any embodiment of the disclosure, and has the beneficial effects described in the above embodiments, which are not repeated here.

Finally, it should be noted that the above embodiments are merely illustrative of the technical solutions of the present disclosure and are not intended to be limiting thereof. For the person skilled in the art of the disclosure, without departing from the concept of the disclosure, simple deductions or substitutions can be made and should be included in the protection scope of the disclosure.

What is claimed is:

1. A control method for a display device, comprising:

reading first configuration parameters from a memory in a first time period when a system powering-on status is monitored; wherein the first configuration parameters comprise configuration parameters required for data receiving, data sending and data swapping;

receiving display data from a system-level chip according to the first configuration parameters;

performing an image basic processing on the received display data; wherein the image basic processing comprises a data swapping processing;

sending data subjected to the image basic processing to a drive circuit of the display device;

reading image optimization configuration parameters from the memory in a second time period; wherein the image optimization configuration parameters comprise at least one selected from the group consisting of: digital gamma configuration parameters, over drive configuration parameters, demura configuration parameters, color enhancement configuration parameters and dithering processing configuration parameters;

performing an image optimization processing on received display data of a subsequent boot animation according to the image optimization configuration parameters; wherein the image optimization processing comprises at least one selected from the group consisting of: a digital gamma processing, an over drive processing, a demura processing, a color enhancement processing and a dithering processing; and sending data subjected to the image optimization processing to the drive circuit of the display device, so as to display the boot animation after the image optimization processing.

2. The control method according to claim 1, wherein the data swapping processing comprises swapping orders of display data, to adapt to an arrangement of pixels of the display panel and a display order of the pixels.

3. The control method according to claim 1, wherein receiving display data from a system-level chip according to the first configuration parameters comprises: when monitoring a completion signal of reading the first configuration parameters , receiving the display data from the system-level chip according to the first configuration parameters.

4. The control method according to claim 1, wherein performing an image optimization processing on received display data of a subsequent boot animation according to the image optimization configuration parameters comprises: when monitoring a completion signal of reading the image optimization configuration parameters, performing the image optimization processing on the received display data of the subsequent boot animation according to the image optimization configuration parameters.

5. A control circuit for a display device, configured for:

reading first configuration parameters from a memory in a first time period when a system powering-on status on is monitored, and reading image optimization configuration parameters from the memory in a second time period; wherein the first configuration parameters comprise configuration parameters required for data receiving, data sending and data swapping; and the image optimization configuration parameters comprise at least one selected from the group consisting of: digital gamma configuration parameters, over drive configuration parameters, demura configuration parameters, color enhancement configuration parameters and dithering processing configuration parameters;

receiving display data from the system-level chip according to the first configuration parameters;

performing an image basic processing on the received display data according to the first configuration parameters; wherein the image basic processing comprises a data swapping processing;

sending data subjected to the image basic processing to the drive circuit of the display device according to the first configuration parameters;

performing an image optimization processing on received display data of a subsequent boot animation according to the image optimization configuration parameters; wherein the image optimization processing comprises at least one selected from the group consisting of: a digital gamma processing, an over drive processing, a demura processing, a color enhancement processing and a dithering processing; and sending data subjected to the image optimization processing and the image basic processing to the drive circuit of the display device, so as to display the boot animation after the image optimization processing.

6. The control circuit according to claim 5, wherein the data swapping processing comprises swapping the received display data or data subjected to the image optimization processing.

7. The control circuit according to claim 5, wherein the data swapping processing comprises swapping orders of display data, to adapt to an arrangement of pixels of the display panel and a display order of the pixels.

8. The control circuit according to claim 5, wherein the memory is a flash memory or an electrically erasable programmable read-only memory.

9. A control method for a display device, comprising:

reading first configuration parameters from a memory in a first time period by a control circuit when a system powering-on status is monitored; wherein the first configuration parameters comprise configuration parameters required for data receiving, data sending and data swapping;

receiving display data from a system-level chip by the control circuit according to the first configuration parameters;

performing an image basic processing on the received display data by the control circuit; wherein the image basic processing comprises a data swapping processing;

sending data subjected to the image basic processing to a drive circuit of the display device by the control circuit;

reading image optimization configuration parameters from the memory in a second time period by the control circuit; wherein the image optimization configuration parameters comprise at least one selected from the group consisting of: digital gamma configuration parameters, over drive configuration parameters, demura configuration parameters, color enhancement configuration parameters and dithering processing configuration parameters;

performing an image optimization processing on received display data of a subsequent boot animation by the control circuit according to the image optimization configuration parameters; wherein the image optimization processing comprises at least one selected from the group consisting of: a digital gamma processing, an over drive processing, a demura processing, a color enhancement processing and a dithering processing; and sending data subjected to the image optimization processing to the drive circuit of the display device by the control circuit, so as to display the boot animation after the image optimization processing.

10. The control method according to claim 9, wherein the data swapping processing comprises swapping orders of display data, to adapt to an arrangement of pixels of the display panel and a display order of the pixels.

11. The control method according to claim 9, wherein receiving display data from a system-level chip by the control circuit according to the first configuration parameters comprises: when the control circuit monitors a completion signal of reading the first configuration parameters, receiving the display data from the system-level chip according to the first configuration parameters.

12. The control method according to claim 9, wherein performing an image optimization processing on received display data of a subsequent boot animation-by the control circuit according to the image optimization configuration parameters comprises: when the control circuit monitors a completion signal of reading the image optimization configuration parameters, performing the image optimization processing on the received display data of the subsequent boot animation according to the image optimization configuration parameters.

13. The control method according to claim 9, wherein the control circuit and the memory are connected through a serial peripheral interface bus or an inter-integrated circuit bus.

* * * * *